US005662593A

United States Patent [19]

Tillman et al.

[11] Patent Number: 5,662,593

[45] Date of Patent: Sep. 2, 1997

[54] MASSAGING APPLIANCE AND CREAM DISPENSER UNIT THEREFOR

[75] Inventors: Menahem Tillman, Hofit; Daphne Topaz; Avraham Topaz, both of Even Yehuda, all of Israel

[73] Assignee: T. Top (1994) Ltd., Netanya, Israel

[21] Appl. No.: 576,975

[22] Filed: Dec. 22, 1995

[51] Int. Cl.[6] ..... A61H 9/00; A61H 15/00

[52] U.S. Cl. ..... 601/159; 601/154; 601/113; 601/131; 601/17

[58] Field of Search ..... 601/112, 113, 601/154, 159, 131, 17

[56] References Cited

U.S. PATENT DOCUMENTS

| | | | |
|---|---|---|---|
| Re. 30,500 | 2/1981 | Springer et al. . | |
| 2,043,114 | 6/1936 | Ruttger-Pelli . | |
| 2,285,105 | 6/1942 | Bacher . | |
| 2,683,451 | 7/1954 | Clark | 601/17 |
| 2,787,998 | 8/1957 | Grossi et al. | 601/17 |
| 2,793,610 | 5/1957 | Smull . | |
| 2,988,084 | 6/1961 | Douglas . | |
| 3,754,548 | 8/1973 | McGrath | 601/154 |
| 3,994,290 | 11/1976 | Springer et al. | 601/131 |
| 4,291,685 | 9/1981 | Taelman | 601/17 |
| 4,427,001 | 1/1984 | Kiefer et al. | 601/17 |
| 4,858,600 | 8/1989 | Gross et al. . | |
| 5,090,402 | 2/1992 | Bazin et al. | 601/17 |

FOREIGN PATENT DOCUMENTS 445929 9/1935 United Kingdom .

*Primary Examiner*—Robert A. Hafer
*Assistant Examiner*—Benjamin K. Koo
*Attorney, Agent, or Firm*—Benjamin Barish

[57] ABSTRACT

A massaging appliance for dispensing a massaging cream includes a cream dispenser unit attachable to the appliance housing and coupled to a rotary motor therein to be rotated thereby, and a non-rotatable rod within the appliance housing axially displaceable towards and away from the dispenser housing for engagement with a piston stem in the dispenser housing to block its rotation, and thereby to cause a piston, within the dispenser housing and while rotating therewith, to move axially towards an end wall in the dispenser housing and to force cream through dispenser openings therein.

18 Claims, 4 Drawing Sheets

FIG,1

MASSAGING APPLIANCE AND CREAM DISPENSER UNIT THEREFOR

FIELD AND BACKGROUND OF THE INVENTION

The present invention relates to a massaging appliance, such as described in U.S. Pat. No. 4,858,600, for massaging the face or other body parts while applying a massaging cream thereto. The invention also relates to a cream dispenser unit particularly useful with the novel massaging appliance.

U.S. Pat. No. 4,858,600 discloses a massaging appliance including an appliance housing enclosing a rotary motor; and a cream dispenser unit attached to the appliance housing and coupled to the rotary motor to be rotated thereby. The cream dispenser unit comprises a dispenser housing rotated by the rotary motor and having an end wall at the end of the dispenser housing distal from the appliance housing and formed with cream dispenser openings therethrough; a piston within the dispenser housing and normally rotated therewith to define with the distal end wall a compartment for containing a supply of the cream to be dispensed; and a piston stem threadedly receiving the piston.

In one described embodiment, cream is dispensed via the dispenser opening by manually rotating the dispenser housing and the piston therein, while holding the piston stem, to thereby advance the piston to force cream through the dispenser opening. In that embodiment, the operation of the cream dispenser unit would have to be interrupted in order to manually dispense cream through the dispenser opening.

A second embodiment described in that patent includes a manual control for manually stopping the rotation of the piston stem, while permitting rotation of the dispenser housing and the piston therein, to advance the piston on the piston stem and thereby to force cream through the dispenser opening. The manual control in that embodiment includes a ring fixed to the piston stem and extending externally of the appliance housing so as to be engageable by the user's finger in order to stop the rotation of the piston stem to force cream through the dispenser opening while the appliance is being used for massaging purposes.

OBJECTS AND BRIEF SUMMARY OF THE INVENTION

According to one aspect of the present invention, there is provided a massaging appliance of the foregoing type, characterized in that the above-mentioned manual control includes: a displaceable rod within the appliance housing and axially displaceable towards and away from the dispenser housing but not rotatable within the appliance housing; a spring normally biassing the displaceable rod to a retracted position within the appliance housing normally spaced from the piston stem in the dispenser housing; and a depressible button carried by the appliance housing for manually moving the displaceable rod to an extended position engageable with the piston stem in the dispenser housing, to block rotation of the piston stem and thereby to cause the piston, while rotating with the dispenser housing, to move axially towards the end wall and thereby to force cream through the dispenser opening.

An object of the present invention is to provide a massaging appliance of the latter type which includes a simplified manual control for manually stopping the rotation of the piston stem, while permitting rotation of the piston thereon, to advance the piston on the piston stem and thereby to force cream through the dispenser opening(s). Another object of invention is to provide a cream dispenser unit which may be sold separately as a cream refill unit for use with the above massaging appliance.

According to another aspect of the present invention, there is provided a cream dispenser unit for attachment to a massaging appliance of the foregoing type, having an appliance housing enclosing a motor for rotating the cream dispenser unit, and a manually displaceable rod receivable within the cream dispenser unit for dispensing cream therefrom; the cream dispenser unit comprising: a dispenser housing attachable to the appliance housing so as to be rotated by the motor therein; the dispenser housing including an end wall thereof distal from the appliance housing and formed with a cream dispenser opening therethrough; a piston within the dispenser housing and normally rotated therewith to define, with the distal end wall, a compartment for containing a supply of cream to be dispensed; and a piston stem within said dispenser housing and threadedly receiving the piston; the end of the piston stem being exposed for engagement by the displaceable rod within the appliance housing, when the dispenser housing is attached thereto, to block rotation of the piston stem and thereby to cause the piston, while rotating with the dispenser housing, to move axially towards the distal end wall to force cream through the dispenser opening.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
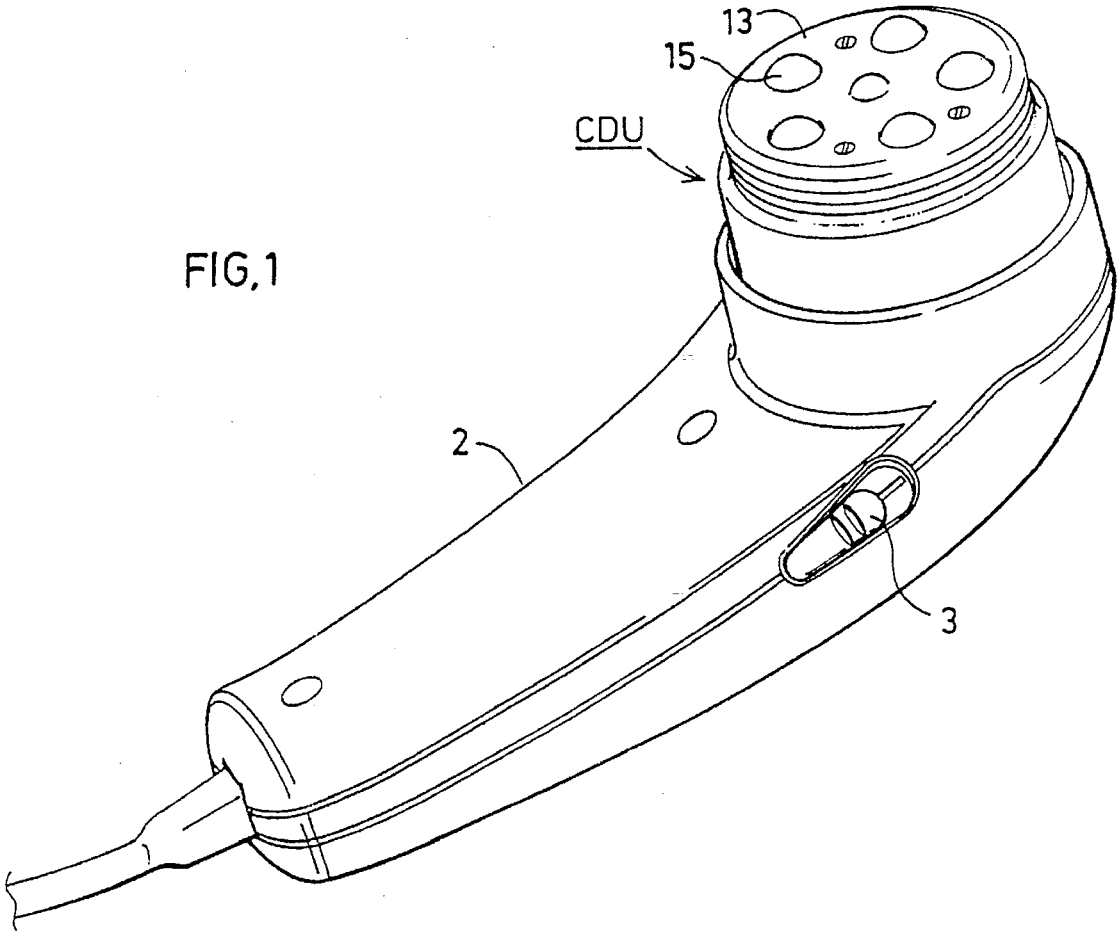
FIG. 1 illustrates one form of massaging appliance constructed in accordance with the present invention.
Figure 2:
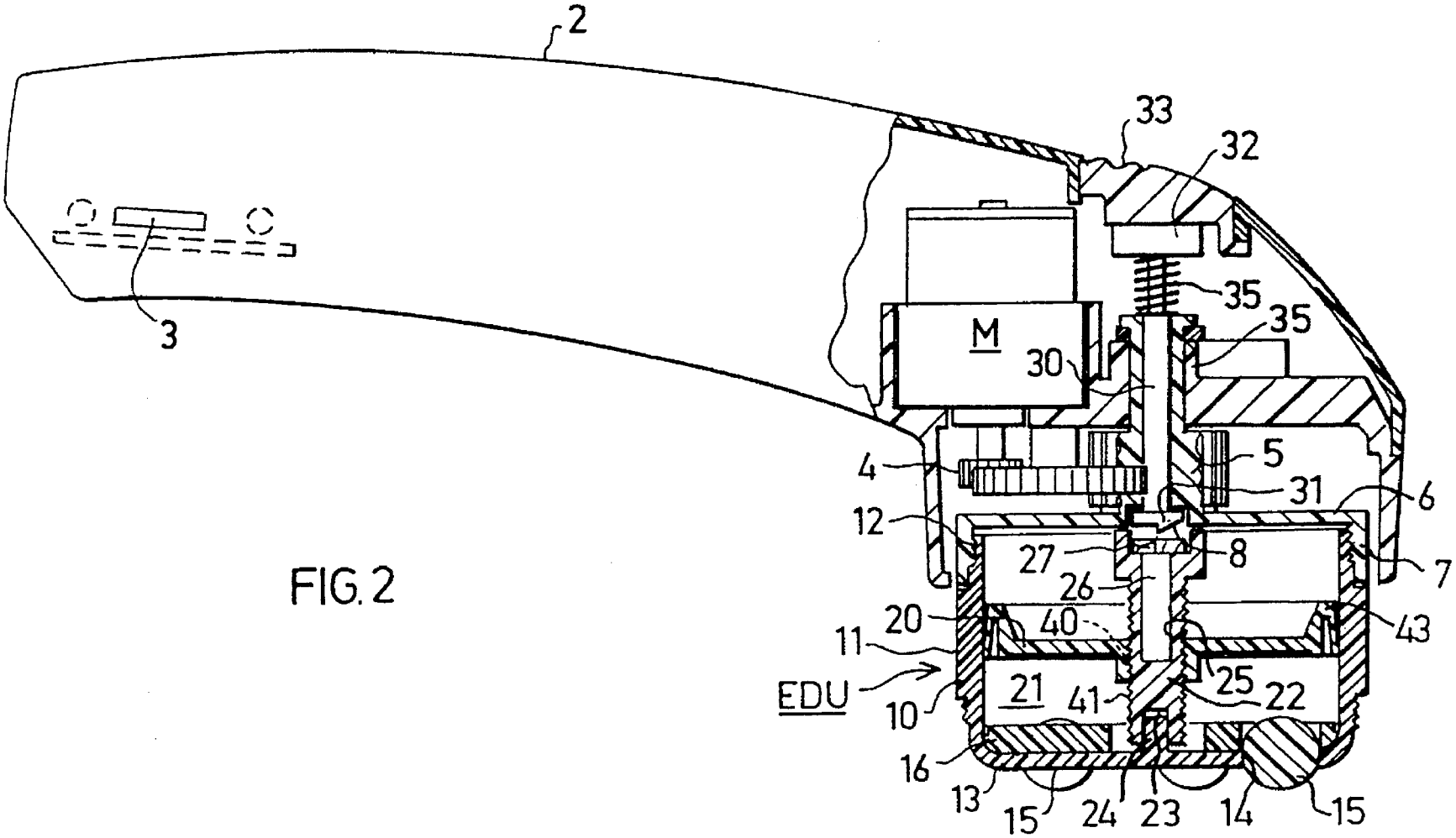
FIG. 2 illustrates the massaging appliance of FIG. 1 with parts in section to show internal structure.

The appliance illustrated in FIGS. 1 and 2 of the drawings includes a appliance housing, generally designated 2, enclosing an electrical rotary motor M manually controlled by a switch button 3 on the outer face of the housing. Appliance housing 2 further includes step-down gearing, generally designated 4, for reducing the rotary speed of the output shaft 5. The output shaft 5 is integrally formed with a cover plate 6 which is rotated at a step-down speed by motor M. Cover plate 6 includes an annular flange 7 for attaching thereto a cream dispenser unit CDU, and is formed with a central opening 8 cooperable with the cream dispenser unit, as will be described more particularly below.

The cream dispenser unit CDU includes a housing 10 constituted of a cylindrical side wall 11 formed with internal threads 12 at its end proximal to the appliance housing 2, and with an end wall 13 distal from the appliance housing 2. The distal end wall 13 includes a plurality of dispenser openings 14 each occupied by a ball 15. In the illustrated example, there are five dispenser openings 14 and five balls 15 arranged in a circular array, all five balls being carried by a ball cage disc 16 fixed to the inner side of the distal end wall 13 by fasteners 17.

A piston 20 is disposed within the dispenser housing 10 to define, with its distal end wall 13, a compartment 21 for containing a supply of cream to be dispensed. Piston 20 is threadedly received on a stem 22. The inner end of piston stem 22 is formed with a blind bore 23 receiving a pin 24 integrally formed with distal end wall 13 of the housing. Pin 24 serves as a bearing permitting relative rotation between the piston stem 22 and the housing 11. The opposite end of piston stem 22 (i.e., the end proximal to the appliance housing 2) is also formed with a blind bore 25 fixedly receiving a metal insert 26 having an enlarged head 27. Head 27 is aligned with opening 8 in cover plate 6 of the appliance housing 2 and is circumscribed by a collar 28 fixed to, or integrally formed wth, piston stem 22.

The output rotary shaft 5, integral with the cover plate 6, is hollow and receives a displaceable metal rod 30 aligned with central opening 8 in the cover plate 6, and also with head 27 of the metal insert 26 fixed to piston stem 22 within the dispenser housing 10. Displaceable rod 30 is formed at one end with a head 31 engageable with head 27 of metal insert 26. The opposite end of rod 30 is fixed by a block 32 to a depressible button 33 normally flush with the outer surface of the appliance housing 2. Rod 30 is normally biassed to its retracted position (as shown in FIG. 2) by a spring 34 between block 32 and a fixed sleeve 35 enclosing hollow shaft 5, but may be manually moved to its extended position by depressing push button 33. When rod 30 is thus moved to its extended position, its head 31 engages head 27 of the metal insert 26 in the dispenser housing 10. Rod 30 is thus axially displaceable but not rotatably movable, within the appliance housing 2.

Head 27 of insert 26 is formed with radial teeth 27', and similarly head 31 of displaceable rod 30 is formed with radial teeth 31' engageable with teeth 27' of insert 27 in the extended position of the displaceable rod. Collar 28, at the upper end of piston stem 22 and circumscribing head 27 of insert 26, projects outwardly of the outer surface of head 27 and thus prevents engagement of head 27 by head 31 of the displaceble rod 30 except in the extended position of rod 30.

Piston 20 within the dispenser housing 10 is formed with internal threads 40 threadedly received on external threads 41 formed in piston stem 22. The outer circumference of piston 20 is thickend, as shown at 43, but is formed with an annular slot 44 extending axially of the piston on the side facing the cream compartment 21, so as to provide an elastic rim 45 firmly pressing against the inner surface of dispenser housing 10. This normally causes piston 20, and piston stem 22 carried thereby, to rotate with the dispenser housing 10 so that the piston normally remains at the same axial position with respect to the dispenser housing. However, when piston stem 22 is blocked from rotation, by the displaceable rod 30 as will be described more particularly below, rotation of the dispenser housing 10 with the piston 20 therein causes the piston to move axially along the piston stem to thereby force cream from compartment 21 through the dispenser openings 14 in the distal end wall 13 of the dispenser housing.

Figure 3:
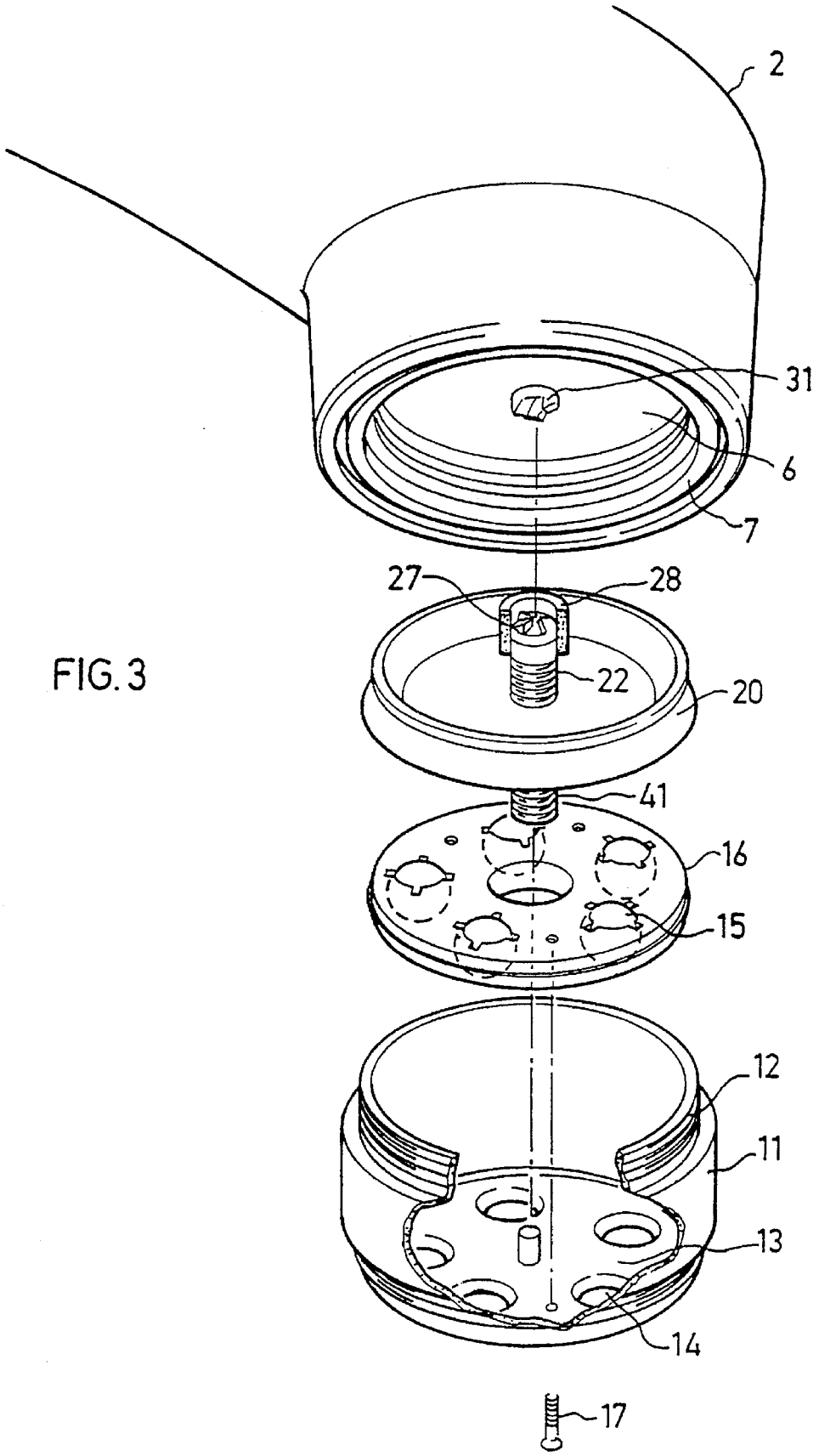
FIG. 3 is an exploded view of the main components of the cream dispenser unit in the massaging appliance of FIGS. 1 and 2.

The manner of using the appliance illustrated in FIGS. 1–3 will be apparent from the above description.

Thus, piston 20 within the dispenser housing 10 would initially be remote from distal end wall 13 of the dispenser housing so as to define a large compartment 21 for the cream to be dispensed. When dispenser housing 10 is attached by its threads 12 to cover plate 6 of the appliance housing 2, operation of the motor, by closing switch 3, will cause the dispenser housing 10, as well as the piston 20 within it, to rotate at a relatively slow speed. As the dispenser housing is thus rotated, the user gently presses end wall 13 of the housing against the body part to be massaged, preferably while also applying a circular movement to the housing, to produce a good massaging action as some cream is picked up and dispensed via the dispensing openings 14 by the balls 15.

Whenever the user wishes to contract the cream compartment 21 in order to force more cream through the dispenser openings 14, the user would depress button 33 to move rod 30 to its extended position, projecting through opening 8 in the cover plate 6 and to engage head 27 of insert 26 fixed to the piston stem 22. This blocks the piston stem from rotating, so that rotation of the piston 20 with the dispenser housing 10 moves the piston axially to contract compartment 21 and thus to force out more cream from the dispenser openings 14.

Figure 4:
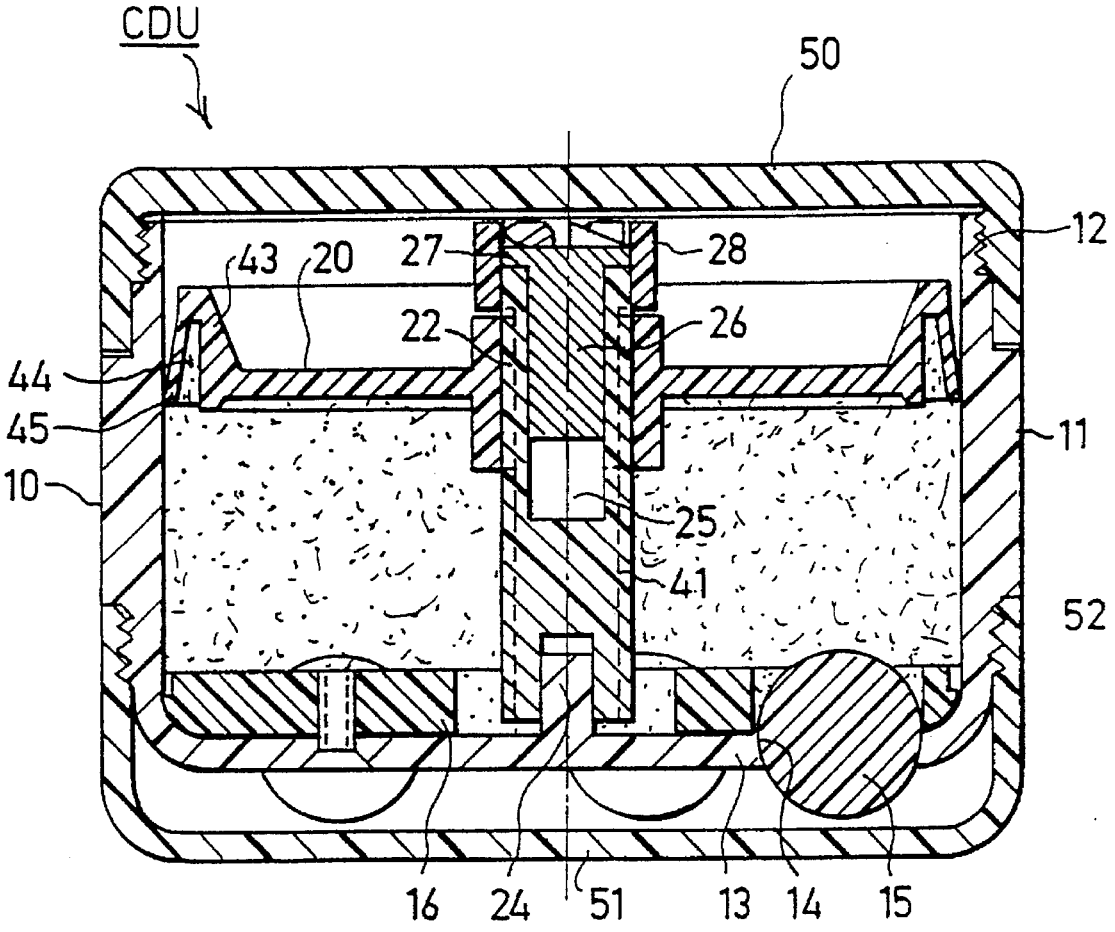
FIG. 4 is a longitudinal sectional view illustrating only the cream dispenser unit as it may be sold as a separate cream refill unit for use with the appliance of FIGS. 1 and 2.

As indicated earlier, it is contemplated that the cream dispenser units would be produced and supplied as separate refill units to be attached to the appliance. FIG. 4 illustrates a cream dispenser unit as would be supplied to the consumer. In such a unit, the piston 20 is in its maximum extended position to provide a compartment 21 of maximum volume for the cream to be dispensed. In addition, the piston side of the dispenser housing is provided with a cover 50 removably applied via threads 12 in one end of the dispenser housing side wall 11 for closing that side of the dispenser housing, and with a second cover 51 removably applied via threads 52 in the opposite end of the dispenser housing side wall for removably closing the discharge openings 14 in the distal end wall 13 of the dispenser housing.

While the invention has been described with respect to one preferred embodiment, it will be appreciated that this is set forth merely for purposes of example, and that many other variations, modifications and applications of the invention may be made.

We claim:

1. A massaging appliance for dispensing a massaging cream, comprising: an appliance housing enclosing a rotary motor; and a cream dispenser unit attached to said appliance housing and coupled to said rotary motor to be rotated thereby; said cream dispenser unit comprising: a dispenser housing rotated by said rotary motor and having an end wall at the end thereof distal from the appliance housing and formed with a cream dispenser opening therethrough; a piston within the dispenser housing and normally rotated therewith to define with said distal end wall a compartment for containing a supply of cream to be dispensed; a piston stem threadedly receiving said piston; and a manual control for manually stopping the rotation of the piston stem while permitting rotation of the piston therein to advance the piston on the piston stem, and thereby to force cream through said dispenser opening; characterized in that said manual control includes: a displaceable rod within said appliance housing and axially displaceable towards and away from said dispenser housing but not rotatable within said appliance housing; a spring normally biassing the displaceable rod to a retracted position within the appliance housing normally spaced from said piston stem in the dispenser housing; and a depressible button carried by said appliance housing for manually moving said displaceable rod to an extended position engageable with said piston stem in the dispenser housing, to block rotation of the piston stem and thereby to cause the piston, while rotating with the dispenser housing, to move axially towards said end wall and thereby to force cream through said dispenser opening.

2. The appliance according to claim 1, wherein said cream dispenser unit is coupled to said rotary motor by a hollow shaft through which said displaceable rod is displaced.

3. The appliance according to claim 2, wherein said hollow shaft coupling the rotary motor to the cream dispenser unit is integrally formed with an end wall attachable to the dispenser housing at the end thereof proximal to the appliance housing, said end wall having an opening centrally therethrough aligned with the piston stem within the dispenser housing.

4. The appliance according to claim 3, wherein said dispenser housing further includes a cylindrical side wall threadedly attached to said proximal end wall.

5. The appliance according to claim 1, wherein the engageable ends of said displaceable rod in the appliance housing and said piston stem in the dispenser housing include metal caps formed with radial teeth for coupling the rods to the piston stem when the displaceable rod is displaced into engagement with the piston stem.

6. The appliance according to claim 1, wherein said distal end wall of the dispenser housing is formed with a central pin receivable within a blind bore formed in the respective end of the piston stem to serve as a rotatable bearing therefor.

7. The appliance according to claim 1, wherein the outer circumference of said piston is thickened and is formed with an annular slot extending axially of the dispenser housing slightly inwardly of the outer circumference of the piston on the side thereof facing said distal end wall, to produce an elastic rim on the piston firmly engaging the inner surface of the dispenser housing.

8. The appliance according to claim 1, wherein said distal end of the dispenser housing is formed with a plurality of dispenser openings each occupied by a ball for massaging the surface engaged thereby while dispensing cream thereto.

9. The appliance according to claim 1, wherein said piston stem further includes a collar circumscribing its end and projecting outwardly of its outer surface.

10. A cream dispenser unit for attachment to a massaging appliance having an appliance housing enclosing a motor for rotating the cream dispenser unit, and a manually displaceable rod receivable within said cream dispenser unit for dispensing cream therefrom; said cream dispenser unit comprising: a dispenser housing attachable to said appliance housing so as to be rotated by the motor therein; said dispenser housing including an end wall thereof distal from the appliance housing and formed with a cream dispenser opening therethrough; a piston within the dispenser housing and normally rotated therewith to define, with said distal end wall, a compartment for containing a supply of cream to be dispensed; and a piston stem within said dispenser housing and threadedly receiving said piston; one end of said piston stem being exposed for engagement by the displaceable rod within the appliance housing, when the dispenser housing is attached thereto, to block rotation of the piston stem and thereby to cause the piston, while rotating with the dispenser housing, to move axially towards said distal end wall to force cream through said dispenser opening.

11. The cream dispenser unit according to claim 10, wherein said dispenser housing further includes a cylindrical side wall formed with threads for threadedly attaching the dispenser housing to the appliance housing.

12. The cream dispenser unit according to claim 11, further including a cover removably attached to the threads of said side wall of the dispenser housing to cover the piston and piston rod thereof when the cream dispenser unit is not attached to the appliance housing.

13. The cream dispenser unit according to claim 12, further including a second cover removably attached to said distal end wall of the dispenser housing to cover the discharge opening therethrough.

14. The cream dispenser unit according to claim 10, wherein the end of said piston stem engageable by the displaceable rod in the appliance housing includes a metal cap fixed to the piston stem and formed with radial teeth engageable by mating radial teeth in the displaceable rod.

15. The cream dispenser unit according to claim 10, wherein said distal end wall of the dispenser housing is formed with a central pin receivable within a blind bore formed in the respective end of the piston stem to serve as a rotatable bearing therefor.

16. The cream dispenser unit according to claim 10, wherein the outer circumference of said piston is thickned and is formed with an annular slot extending axially of the dispenser housing slightly inwardly of the outer circumference of the piston on the side thereof facing said distal end wall to produce an elastic rim on the piston firmly engageable with the inner surface of the dispenser housing.

17. The cream dispenser unit according to claim 10, wherein said distal end of the dispenser housing is formed with a plurality of dispenser openings each occupied by a ball for massaging the surface engaged thereby while dispensing cream thereto.

18. The cream dispenser unit according to claim 10, wherein said piston stem further includes a collar circumscribing its end and projecting outwardly of its outer surface.

* * * * *